US006000638A

United States Patent [19]

Martin

[11] Patent Number: 6,000,638

[45] Date of Patent: Dec. 14, 1999

[54] APPARATUS FOR STRENGTHENING A FUEL INJECTOR TIP MEMBER

[75] Inventor: David E. Martin, Normal, Ill.

[73] Assignees: Caterpillar Inc., Peoria, Ill.; Lucas Industries PLC, Solihull, United Kingdom

[21] Appl. No.: 08/963,425

[22] Filed: Nov. 3, 1997

[51] Int. Cl.[6] ..... F02M 59/00

[52] U.S. Cl. ..... 239/533.2; 239/88; 239/533.9; 239/96

[58] Field of Search ..... 239/533.2, 533.8, 239/533.9, 533.12, 88, 96, 585.5, 591; 29/890.12, 890.122, 890.143

[56] References Cited

U.S. PATENT DOCUMENTS

| | | | |
|---|---|---|---|
| 3,282,512 | 11/1966 | Bluhm et al. | 239/533.8 |
| 3,640,467 | 2/1972 | Moller et al. | 239/224 |
| 4,007,880 | 2/1977 | Hans et al. | 239/585.5 |
| 4,200,231 | 4/1980 | Knape | 239/533.8 X |
| 4,280,662 | 7/1981 | Erickson et al. | 239/591 |
| 4,381,081 | 4/1983 | Hastings | 239/707 |
| 4,526,323 | 7/1985 | Seifert | 239/453 |
| 4,576,338 | 3/1986 | Klomp | 239/533.12 X |
| 4,686,737 | 8/1987 | Fortune | 15/415 R |
| 4,761,959 | 8/1988 | Romey et al. | 60/740 |
| 4,765,543 | 8/1988 | Jaksa et al. | 239/533.2 |
| 4,790,055 | 12/1988 | Raufeisen et al. | 29/156.7 |
| 4,835,971 | 6/1989 | Romey et al. | 60/740 |
| 4,891,935 | 1/1990 | McLaurin et al. | 60/39.37 |
| 4,978,074 | 12/1990 | Weinand | 239/585 |
| 5,000,144 | 3/1991 | Schweinzer et al. | 123/276 |
| 5,337,961 | 8/1994 | Brambani et al. | 239/397.5 |
| 5,487,368 | 1/1996 | Bruning | 123/470 |

*Primary Examiner*—Andres Kashnikow
*Assistant Examiner*—Steven J. Ganey
*Attorney, Agent, or Firm*—William E. McCracken; Marshall, O'Toole, Gerstein, Murray & Borun

[57] ABSTRACT

A fuel injector includes a tip member having a further member establishing an interference fit about an outer surface thereof at an injection end to minimize the possibility of fracture or other failure.

7 Claims, 3 Drawing Sheets

APPARATUS FOR STRENGTHENING A FUEL INJECTOR TIP MEMBER

TECHNICAL FIELD

The present invention relates generally to fuel injectors, and more particularly to an apparatus for preventing failure of a tip member of a fuel injector.

BACKGROUND ART

Current fuel injectors include a tip member carried in a jacket or case. A barrel is threaded into or otherwise secured to an upper end of the case. A check along with other components are disposed within the case and the check is movable into engagement with a check seat formed on an inside surface of the tip member. In the past, a two-piece tip member was utilized wherein a lower member containing the seat and injection orifices was mounted in an elongate upper member through which the check extended.

Recently, fuel injector designs have been developed wherein improved response times are obtained through the use of a valve which directs high pressure fuel onto the top of the check. The application of the high pressure fuel to the top of the check results in very high check velocities. While these high check velocities enable a quick end of injection, which is beneficial from an emissions standpoint, the momentum built up by the check is in excess of the design limits of the two piece tip member of prior fuel injector designs. That is, if the two piece design were utilized, the lower member could be pushed out of contact with the elongate upper member thereby leading to damage not only to the injector but possibly engine components. Accordingly, a single or integral tip design must be utilized. However, tip failures have occurred, indicating the difficulty of designing a tip member which will withstand simultaneous check impact and the high pressures that are encountered in current fuel injectors.

SUMMARY OF THE INVENTION

A fuel injector includes a tip member which is strengthened through the use of a surrounding member so that the incidence of failure of the tip member is minimized.

More particularly, in accordance with one aspect of the present invention, a fuel injector includes a tip member having an outer surface disposed at an injection end and a hollow interior defined by walls including a check seat disposed in the injection end. An injector check is disposed in the hollow interior and is movable into engagement with the check seat. A further member surrounds the outer surface of the tip member and has an interference fit therewith wherein the further member induces a compressive hoop stress in the tip member at the injection end to resist fracturing of the tip member when the check moves into engagement with the check seat.

Preferably, the further member and the outer surface of the tip member are complementarily-shaped. In accordance with a specific embodiment, the further member on the outer surface of the tip member are circular in cross-section.

Also preferably, the further member has an axial extent substantially less than axial extent of the tip member. Still further in accordance with the preferred embodiment, the further member is axially coincident with the check seat.

In accordance with a further aspect of the present invention, a fuel injector includes a tip member having a outer surface disposed at an injection end and a hollow interior defined by walls including a check seat disposed at the injection end. An injector check is disposed in the hollow interior and is movable into engagement with the check seat. A further member surrounds the outer surface of the tip member and has an interference fit therewith wherein the further member induces a compressive hoop stress in the tip member at the injection end to resist fracturing of the tip member when the check moves into engagement with the check seat. In addition, the further member has an axial extent substantially less than an axial extent of the tip member and the further member is axially coincident with the check seat.

The present invention strengthens the injection end of the tip member so that fracturing and failure thereof are reduced.

BEST MODE FOR CARRYING OUT THE INVENTION

Figure 1:
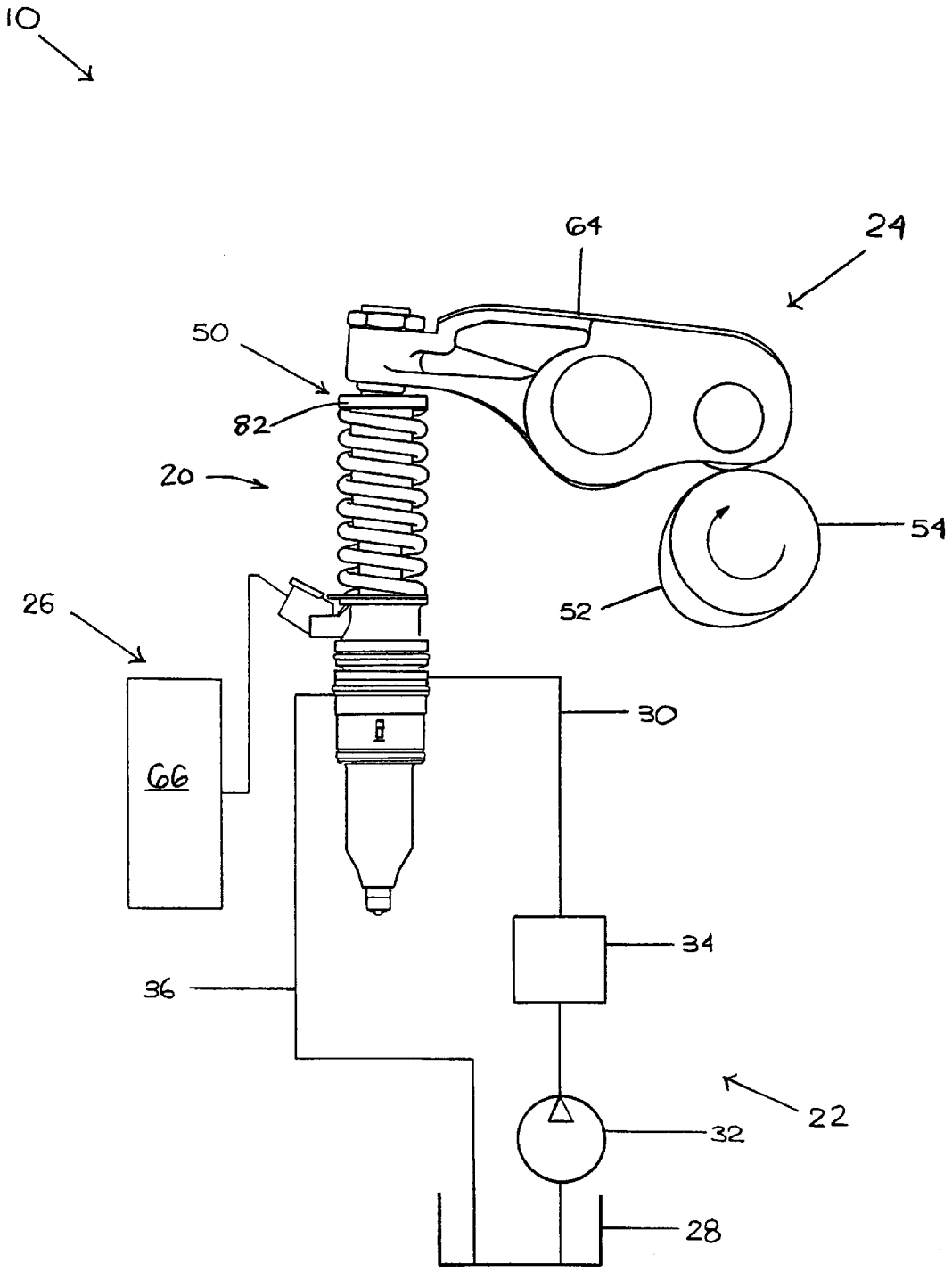
FIG. 1 is a diagrammatic general schematic view of an electronically-controlled fuel injector system.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modified-cycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically actuated device or hydraulically actuated device. In the embodiment shown a tappet and plunger assembly 50 associated with the injector 20 is mechanically actuated indirectly or directly by a cam lobe 52 of an engine-driven cam shaft 54. Also in the embodiment shown, the cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) fuel injection pressure; (4) the number of separate injection segments during each injection cycle; (5) the time interval(s) between the injection segments; and (6) the fuel quantity delivered during each injection segment of each injection cycle.

Preferably, each injector 20 is a unit injector which includes in a single housing apparatus for both pressurizing fuel to a high level (for example 207 MPa (30,000 p.s.i.) and injecting the pressurized fuel into an associated cylinder. Although shown as a unitized injector 20, the injector could alternatively be of a modular construction wherein the fuel injection apparatus is separate from the fuel pressurization apparatus.

Figure 2:
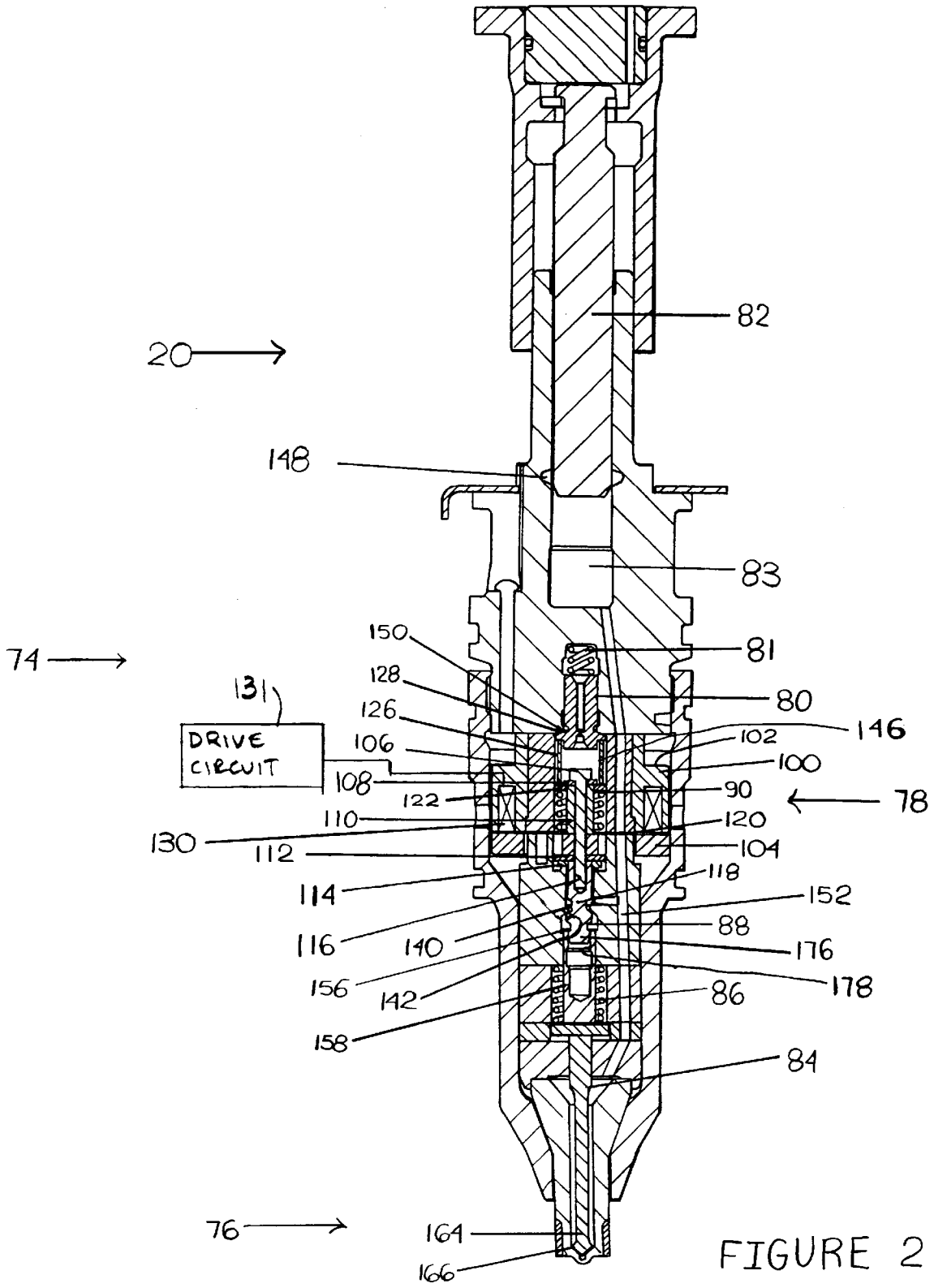
FIG. 2 is a cross-sectional view of the fuel injector of FIG. 1.
Figure 3:
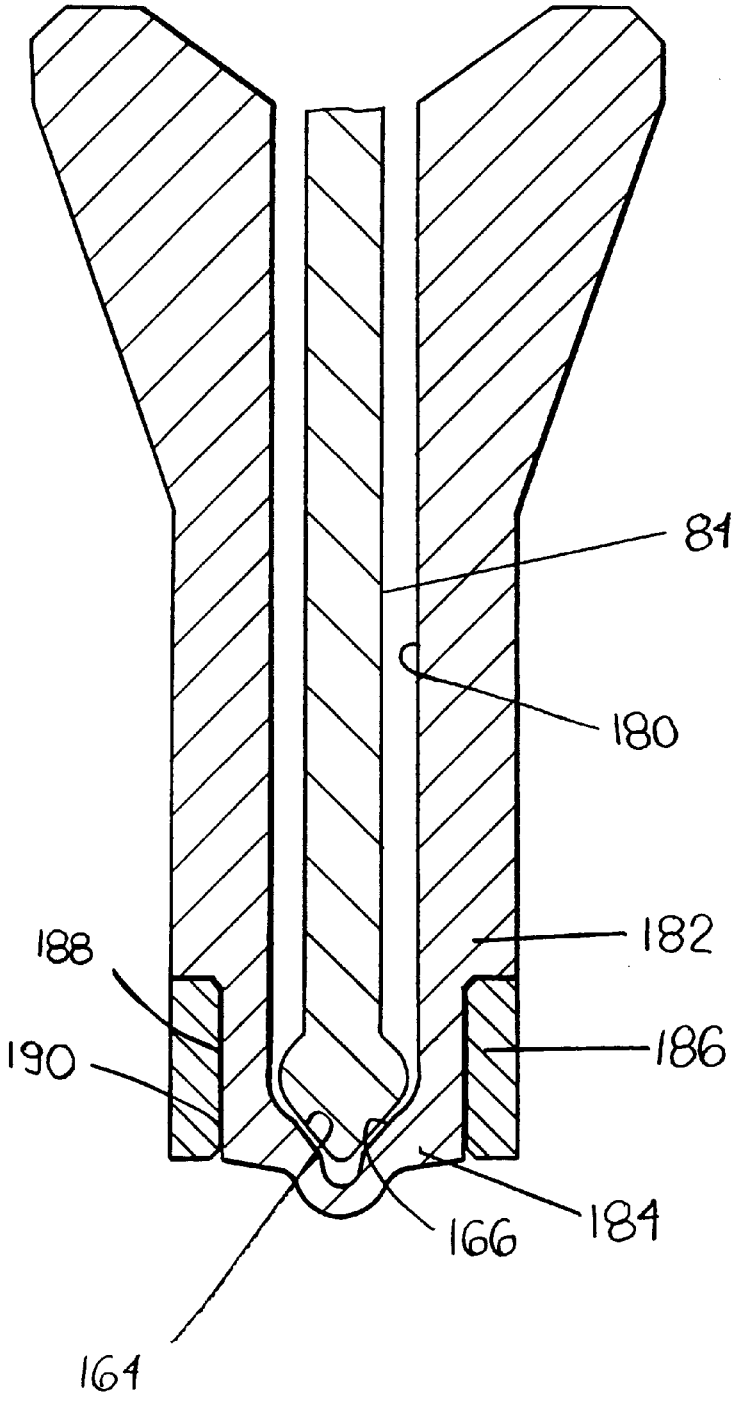
FIG. 3 is an enlarged fragmentary view of a portion of the fuel injector of FIG. 1 illustrating the present invention.

Referring now to FIGS. 2 and 3, the injector 20 includes a housing 74, a nozzle portion 76, an electrical actuator 78, a high pressure spill valve 80, a spill valve spring 81, a plunger 82 disposed in a plunger cavity 83, a check 84, a check spring 86, a two-way direct operated check (DOC) valve 88 and a DOC spring 90. In the preferred embodiment, the spill valve spring 81 exerts a first spring force (e.g., approximately 30 newtons) when compressed whereas the DOC spring 90 exerts a second spring force greater than the first spring force (e.g., approximately 150 newtons) when compressed.

The electrical actuator 78 may comprise a solenoid 100 having a stator 102 and an armature assembly in the form of a single armature 104. A bolt 106 and a washer 108 bear against a cylindrical member 110 which in turn bears against the armature 104. The bolt 106 further extends through a pair of additional washers 112, 114 into a threaded bore 116 in a valve stem or poppet 118 of the DOC valve 88. (The washer 114 also surrounds the poppet 118.)

The DOC spring 90 is placed in compression between a surface 120 of the armature 104 and a DOC spring preload spacer 122 which abuts the washer 108. A cylindrical spill valve spacer 126 is disposed between the spacer 122 and a shouldered portion 128 of the spill valve 80. The DOC spring preload spacer 122 is axially slidable over the cylindrical member 110, for reasons explained hereinafter.

Prior to the time that injection is to occur, a solenoid coil 130 disposed in the solenoid stator 102 and coupled to a drive circuit 131 is unenergized. Accordingly, the armature 104 is not attracted to the solenoid stator 102, thereby permitting the spill valve spring 81 to open the spill valve 80. Fuel circulates from the transfer pump and the fuel supply passage 30 into internal passages (not shown) of the fuel injector 20 which connect with a space 146 below the shouldered portion 128. The fuel passes through the open spill valve 80 into a space 150 above the spill valve 80 and thence through one or more further passages (not shown) to the plunger cavity 83. When the plunger 82 is in the full upward position, passages (also not shown) in the plunger 82 conduct the fuel to an annular recess 148 surrounding the plunger 82, which is in turn coupled in fluid communication with the drain passage 36. The fuel thus recirculates through the injector 20 during non-injection portions of each engine cycle for the purpose of cooling and to fill the plunger chamber.

Also at this time, the DOC valve poppet 118 is disposed in an open position at which a sealing surface 140 of the valve poppet 118 is spaced from a valve seat 142 defined by a DOC body 144.

When injection is to occur, a first pull-in current and first holding current are initially applied to the solenoid coil 130 and thereafter a second pull-in current and second holding current having magnitudes in general greater than the first pull-in current and the first holding current, respectively, are applied to the solenoid coil 130. Application of the first pull-in current and first holding current moves the armature 104 a first distance toward the solenoid stator 102. The armature 104 develops a motive force greater than the spring force exerted by the spring 81 but less than the spring force exerted by the DOC valve spring 90. The spill valve 80 is thus closed and the DOC valve is moved upwardly to an intermediate position at which the DOC valve 88 remains open. Application of the second pull-in current and second holding current cause the armature 104 to develop a motive force greater than the spring force exerted by the DOC valve spring 90. Thus, the DOC valve 88 is moved upwardly causing the sealing surface 140 to contact the seat 142. During such movement, the cylindrical member 110 moves axially upward within the DOC spring preload spacer 122 so that an over-travel characteristic is obtained. Fluid captured in a space above an upper surface 156 of a DOC piston 158 bleeds via a controlled leakage path between a head portion 176 of the valve poppet 118 and a wall 178 of the DOC piston 158 and through a passage (not shown) extending through the side walls of the DOC piston 158 to drain. A low fluid pressure zone is thereby established above the DOC piston 158 thereby causing the check 84 to move upwardly and initiate fuel injection. It should be noted that this controlled leakage path is sufficiently small to maintain a high fluid pressure condition when the DOC valve 88 is open but is large enough to quickly bleed off the high pressure fluid when the DOC valve 88 is closed.

When injection is to be terminated, the current supplied to the solenoid coil 130 may be reduced to the first holding level or to a lower level. In any case, the magnetic attractive force on the armature 104 is thus reduced, permitting the DOC spring 90 initially to move the valve poppet 118 downwardly to the open position whereby fluid communication is again established between the fuel passage 152 and the space above the upper surface 156 of the DOC piston 158. The application of high fuel pressure to the top of the DOC piston 158 and the force exerted by the spring 86 cause the check 84 to move downwardly such that the check tip 164 engages the seat 166, thereby preventing further fuel injection. Subsequently, the current supplied to the solenoid coil 130 may be reduced to zero or any other level less than the first holding level (if it has not already been so reduced). Regardless of whether the applied current level is immediately dropped to the first holding level or to a level less than the first holding level, the spill valve spring 81 opens the spill valve 80 after the DOC spring 90 moves the valve poppet 118 downwardly. Fuel then circulates through the spill valve 80, the spaces 146 and 150, the plunger cavity 83, the passages in the plunger 82 and the annular recess 148 to drain for cooling purposes as described above.

Still further, multiple or split injections per injection cycle can be accomplished by supplying suitable waveform portions to the solenoid coil 130.

Industrial Applicability

As should be evident from the foregoing, each injection cycle includes one or more downward movements of the check tip 164 into engagement with the seat 166. The momentum built up by the check 84 immediately prior to contact of the tip 164 with the seat 166, together with the high fuel pressures in a check passage 180 located within a tip member 182, can cause fracturing at an injection end 184 of the tip member 182. In order to overcome this problem, a further member 186 in the form of an annular ring or other surrounding element is placed in a groove 188 surrounding the injection end 184, and more particularly, the seat 166. The member 186 forms an interference fit with outer walls 190 defining the groove 188 so that compressive hoop stresses are introduced in the injection end 184.

Preferably, the outer surface 190 and the member 186 are circular in cross section, although this need not be the case.

Also, the axial extent of the member 186 is preferably (although not necessarily) substantially less than the axial extent of the balance of the tip member 182.

By setting up compressive hoop stresses in the injection end 184, the maximum tensile hoop stress experienced by the tip member 182 at the injection end 184 during impact of the check tip 164 against the seat 166 is reduced, owing to the fact that the stress starts out as being compressive. Further, the initial compressive hoop stress results in a reduced mean stress, which in turn permits increased alternating stress in the tip. These benefits all increase the fatigue life of the tip member 182.

Numerous modifications and alternative embodiments of the present invention will be apparent to those skilled in the art in view of the foregoing description. Accordingly, this description is to be construed as illustrative only and is for the purpose of teaching those skilled in the art the best mode of carrying out the invention. The details of the structure and/or function may be varied substantially without departing from the spirit of the invention, and the exclusive use of all modifications which come within the scope of the appended claims is reserved.

I claim:

1. A fuel injector, comprising:

a tip member having an outer surface disposed at an injection end and a hollow interior defined by walls including a check seat disposed at the injection end;

an injector check disposed in the hollow interior and movable into engagement with the check seat; and a ring-shaped member surrounding the outer surface of the tip member and having an interference fit therewith wherein the ring-shaped member induces a compressive hoop stress in the tip member at the injection end to resist fracturing of the tip member when the check moves into engagement with the check seat and wherein the ring-shaped member has an axial extent substantially less than an axial extent of the tip member.

2. The fuel injector of claim 1, wherein the further member and the outer surface of the tip member are complementarily shaped.

3. The fuel injector of claim 1, wherein the further member and the outer surface of the tip member are circular in cross-section.

4. The fuel injector of claim 1, wherein the further member is axially coincident with the check seat.

5. A fuel injector, comprising:

a tip member having an outer surface disposed at an injection end and a hollow interior defined by walls including a check seat disposed at the injection end;

an injector check disposed in the hollow interior and movable into engagement with the check seat; and a further member surrounding the outer surface of the tip member and having an interference fit therewith wherein the further member induces a compressive hoop stress in the tip member at the injection end to resist fracturing of the tip member when the check moves into engagement with the check seat and wherein the further member has an axial extent substantially less than an axial extent of the tip member and the further member is axially coincident with the check seat.

6. The fuel injector of claim 5, wherein the further member and the outer surface of the tip member are complementarily shaped.

7. The fuel injector of claim 5, wherein the further member and the outer surface of the tip member are circular in cross-section.

* * * * *

UNITED STATES PATENT AND TRADEMARK OFFICE

CERTIFICATE OF CORRECTION

PATENT NO. : 6,000,638

DATED : December 14, 1999

INVENTOR(S) : Martin, David E.

It is certified that error appears in the above-identified patent and that said Letters Patent is hereby corrected as shown below:

At column 6, claim 2, line 3, delete "further" and insert therefor --ring-shaped--.

At column 6, claim 3, line 6, delete "further" and insert therefor --ring-shaped--.

At column 6, claim 4, line 9, delete "further" and insert therefor --ring-shaped--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*